US005520381A

United States Patent [19]

Lo et al.

[11] Patent Number: 5,520,381

[45] Date of Patent: May 28, 1996

[54] HIGH CAPACITY, LOW JAM ENVELOPE FEEDER FOR LASER PRINTER

[75] Inventors: Thomas Y. Lo, Fremont; Dan D. Le, San Jose; Buu Chau, Oakland, all of Calif.

[73] Assignee: Genesis Technology, Inc., Hayward, Calif.

[21] Appl. No.: 279,250

[22] Filed: Jul. 21, 1994

[51] Int. Cl.[6] ..... B65H 3/06

[52] U.S. Cl. ..... 271/117; 271/2; 271/121; 271/126; 271/147

[58] Field of Search ..... 271/117, 118, 271/121, 124, 126, 147, 148, 2

[56] References Cited

U.S. PATENT DOCUMENTS

| | | | |
|---|---|---|---|
| 4,647,030 | 3/1987 | Tomita | 271/22 |
| 4,942,435 | 7/1990 | Kneisel et al. | 271/148 |
| 5,026,042 | 6/1991 | Miller | 271/121 |
| 5,192,068 | 3/1993 | Parker et al. | 271/121 |

FOREIGN PATENT DOCUMENTS

| | | | |
|---|---|---|---|
| 0059132 | 4/1983 | Japan | 271/10 |

*Primary Examiner*—H. Grant Skaggs

*Attorney, Agent, or Firm*—Ronald C. Fish; Falk, Vestal & Fish

[57] ABSTRACT

An envelope feeder using a combination of frictional force differentiation and three discrimination edges, two of which are provided by flexible materials spaced apart from and on either side of a metal envelope separating plate to prevent multiple envelope feeds into printers. The flexible plate on the media side of the metal envelope separating plate is at a more acute angle to the vertical than the metal envelope separating plate, and the metal envelope separating plate of the invention is at a more acute angle than the angles used by metal envelope separating plates in the prior art. A third discrimination edge is provided by a flexible plate which is behind the metal envelope separating plate and which has an angled portion which is longer than the angled portion of the metal envelope separating plate so as to extend past the end of the angled portion of the metal envelope separating plate by about 0.15 inches.

19 Claims, 4 Drawing Sheets

HIGH CAPACITY, LOW JAM ENVELOPE FEEDER FOR LASER PRINTER

BACKGROUND OF THE INVENTION

The invention pertains to the field of envelope feeders for laser printers.

Envelope feeders for laser printers have been in use for several years now. Envelope feeders function to receive a stack of envelopes and feed them, hopefully one at a time, into the paper entry port of a printer such as a laser printer. Paper trays typically use corner separators, but these types of separators will not work for card stock and envelopes because they damage the corners of the paper with heavier materials.

Different types of feed mechanisms exist for envelope feeders. Some use gravity feed and some use vacuum feed. Others use motor driven compression stacks to compress a stack of envelopes. A prime example of the latter type of prior art of high-capacity, force feed envelope feeders is the JT25-XXXX 250 envelope feeder first introduced by Genesis Technology of Hayward, Calif. about five years ago.

The problem with all envelope feeders is jams. Jams are frequently caused by multiple feeds, i.e., more than one envelope is taken from the stack and fed into the printer thereby jamming the envelope transport mechanism within the printer. Some technology must be used to separate the envelopes from each other so that only one envelope is fed into the printer at any one time. The difficulty with envelopes that does not exist with stacks of paper is that envelopes have pockets and many different manufacturing styles, paper weights, paper types with varying degrees of coefficients of friction and many different characteristics in terms of trapping air. Many envelope feeders such as the JT25-XXXX predecessor to the invention use the friction retard principle. In this technology, a force is put on the stack of envelopes acting as a normal which defines the frictional forces when considered in light of three different coefficients of friction between: (1) a feed roller and the top envelope, (2) the envelopes in the middle of the stack, and (3) the bottom envelope and a cork pad on the bottom plate. The three frictional forces are: $F_2$ acting on the interfacial surfaces between envelopes in the middle of the stack, i.e., the force required to pull an envelope out of the middle of the stack, the frictional force $F_3$ resisting movement of the bottom envelope in contact with a cork bottom plate, i.e., the force to pull the bottom envelope out of the stack, and the frictional force $F_1$ between the top envelope and a feed roller, i.e., the force to pull the top envelope out of the stack with the roller stationary, i.e., with the roller not rolling. In the preferred embodiment of the invention, the roller is EPDM rubber of hardness 40±5 durometer value, Shore A (available commercially from VIP Rubber). Separation is accomplished by depending upon the differences between the frictional forces. If $F_1$ is greater than $F_2$ and $F_3$ is greater than $F_2$ and $F_1$ is greater than $F_3$, then separation should occur. Since $F_1$ must be the largest force, the material of the feed roller must be selected carefully and maintained carefully in terms of cleanliness and aging so that $F_1$ always is the largest of the three forces. Such an approach frequently leads to multiple feeds and is not reliable enough for some users for several reasons. For example, as the number of envelopes in the stack changes, the relative magnitude of the $F_2$ force changes for each envelope. This is because the normal force on each envelope is different since the stack of envelopes acts like a series of springs coupled together, each offsetting part of the normal force. Also, because the envelopes have different air catching qualities, different glue and flap characteristics, the coefficients of friction vary between envelopes of different types and made by different manufacturers. Thus, this mechanism may work satisfactorily for some envelopes but not for others.

Accordingly a need has arisen for a more reliable high capacity envelope feeder which uses additional mechanism for envelope separation and normal force control to reduce the number of multiple feeds.

SUMMARY OF THE INVENTION

According to the teachings of the invention, two additional separation edges made of plastic are added on either side of a metal envelope guide acting as a backstop against which the top envelope is pinched by the feed roller. A feed roller made of EPDM rubber of approximately 45 durometer, Shore A hardness is spring loaded to press down on the top envelope in a stack of envelopes in a housing having a movable floor. The feed roller is motor driven under control of a microprocessor to rotate so as to push the top envelope out of the stack when a signal is received from an attached printer than an envelope is to be fed into the printer. The feed roller pivots upward against the force of two springs which tend to pull it down on the stack. The stack of envelopes rests on a cork lined movable floor. This floor is moved upward by another motor under microprocessor control. The microprocessor is coupled to a microswitch which is linked to the pivoting frame upon which the feed roller is mounted. The microprocessor moves the floor upward to push the stack of envelopes upward whenever the feed signal has caused one envelope to be fed into the printer and the stack becomes smaller. The microswitch is rigged so as to change states whenever the stack becomes smaller by an amount sufficient to drop the normal force applied downward on the stack by the feed roller below a desired level. The desired level of normal force is that needed to satisfy certain frictional force inequalities necessary to achieve envelope separation without multiple feeds based upon the coefficients of friction between the material of the feed roller and the material type of the top envelope, between the envelopes themselves and between the bottom envelope and the cork lined movable floor.

A metal edge separating plate adjacent to the front edge of the stack serves as the main output guide and provides one separation edge. The metal edge separating plate has a vertical portion which is parallel to the front edge of a stack and a sloped portion which is inclined to the plane of the front edge of the stack at an acute angle of about 38°. The vertical and sloped portions of the metal edge separation plate are joined at a knee which is located just below the lowest portion of the top envelope in the stack. The lowest portion of the top envelope takes into account the bowing downward of the middle of the envelope caused by the normal force pressing down on the top envelope in the stack by the feed roller.

The two additional separation edges are provided by flexible plastic plates attached to the front and back sides of the metal edge separating plate. A first flexible plastic plate has a vertical portion parallel to the front edge of a stack of envelopes and a sloped portion which is inclined to the plane of the front edge of the stack by an acute angle. The vertical and sloped portion are joined at a knee which also is located below the lowest portion of the top envelope. The sloped portion of the first flexible plate has a slightly more acute angle to the vertical than the angled portion of the metal edge separating plate by about 3°, i.e., has an angle of about 35° to the vertical. The length of the angled portion of the first flexible plate is such that the tip thereof touches a horizontal plane passing through the tip of the angled portion of the metal edge separating plate. The vertical portion of the first flexible plate is spaced away from the vertical portion of the metal edge separating plate by about 60–80 mils.

A second flexible plate has the same general configuration as the first flexible plate but is mounted to the backside of the metal edge separating plate so as to have its knee generally aligned with the knee of the metal edge separating plate. The vertical portion of the second flexible plate is spaced slightly away from the vertical portion of the metal edge separating plate. The length of the angled portion of the second flexible plate is such that the tip thereof extends past the tip of the tip of the metal edge separating plate by about 0.15–0.20 inches.

In the preferred embodiment, the teachings of the invention contemplate an envelope feeder for feeding one envelope at a time from a stack of envelopes to a printer, comprising:

- a housing for protecting a stack of envelopes each of which has a flap which folds over, said stack of envelopes having an axis passing through each envelope;
- a movable floor within said housing having a raised portion thereof on one side of said floor so as to compensate for the greater thickness of the envelopes at the edges having the flaps so as to cause a large stack of envelopes resting on said floor to have a top surface which is approximately level;
- a motor and belt drive system controlled by a microprocessor to raise said floor;
- a feed roller means located within said housing adjacent the top of said stack of envelopes and coupled to a motor controlled by said microprocessor, for friction engaging an envelope from the top of said stack and rotating so as to move said envelope out of said stack;
- separation means for engaging said top envelope and any other envelope(s) further down in said stack which may also be moving out of said stack under the influence of frictional forces generated by said feed roller means and for applying forces to said envelopes so as to block all but said top envelope from reaching said printer.

DETAILED DESCRIPTION OF THE PREFERRED EMBODIMENT

Figure 1:
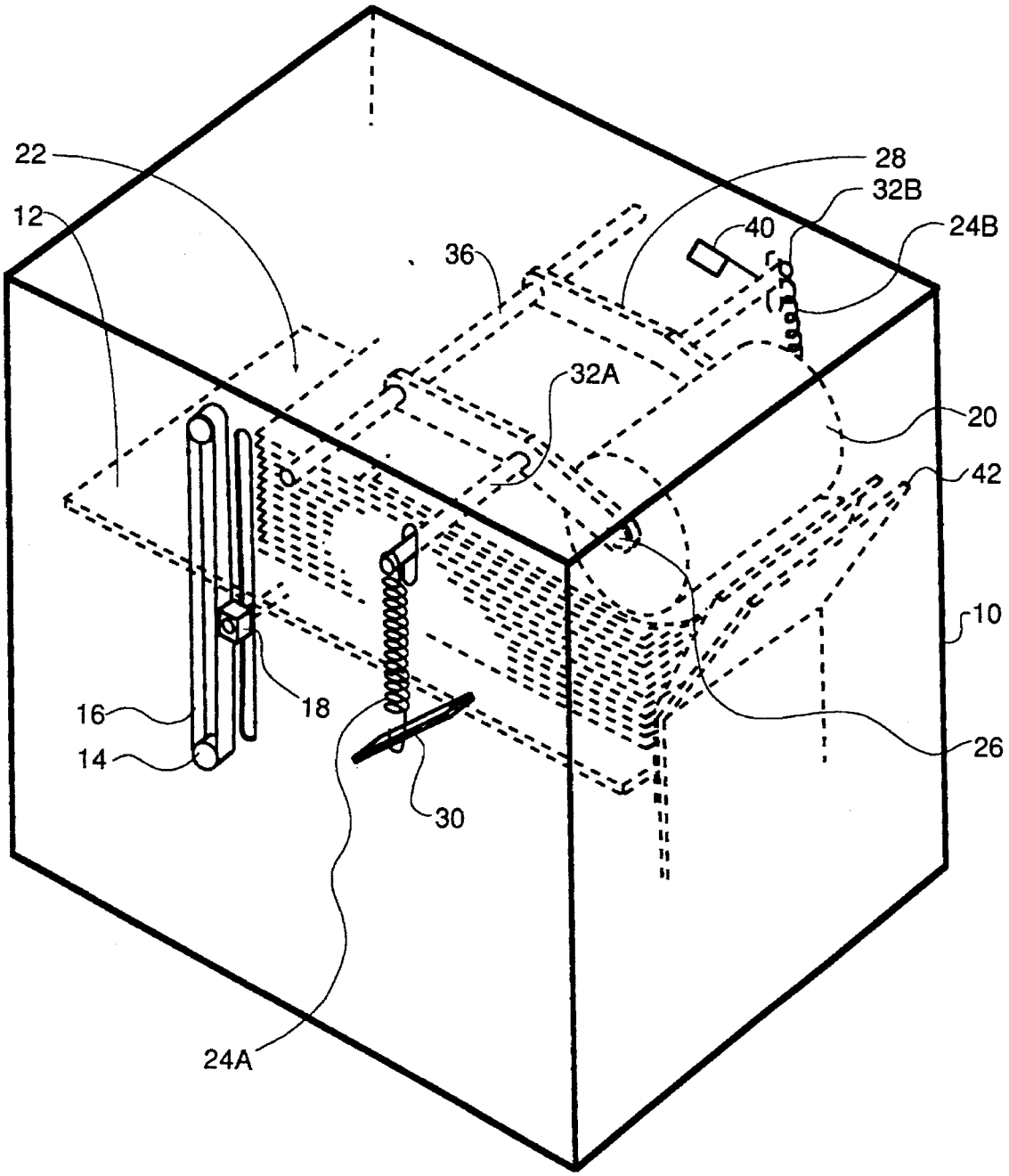
FIG. 1 is perspective view of an envelope feeder according to the teachings of the invention.

Referring to FIG. 1, there is shown a perspective view of an envelope feeder of the type in which the invention may be fruitfully employed. A housing 10 has an internal cavity with a movable floor 12 the height of which relative to the bottom of the housing is controlled by a motor driven by a microprocessor (neither of which are shown). The motor drives a shaft 14 and belt 16 to which is affixed a floor hoisting mechanism 18 which is affixed to the bottom of the floor. A rubber feed roller 20 of EPDM material (available commercially from VIP Rubber or ENBI Corp) having 40±5 durometer value, Shore A hardness applies a normal force downward on a stack 22 of envelopes under the influence of springs 24A and 24B which are coupled between anchor points such as point 30 on housing 10 and movable shafts 32A and 32B coupled to a frame 28. The preferred springs are made by the Lee Spring Co. of Brooklyn, N.Y. having model number LE-018B-12MW and have an initial tension of 0.303 lb./inch and a maximum load of 0.14 lb. The direction of wind is 1.5 lb, and the spring is made of music wire optionally having a diameter of 0.018 inches and a free length of 2.25 inches with an outside diameter of 0.188 inches with a pre-tinned or zinc plated finish. Of course any other spring that serves the function detailed herein for this particular spring type will be within the teachings of the invention.

The springs 24 used in the envelope feeder according to the teachings of the invention have a stronger spring constant than the springs found in the prior art JT25-XXXX units so they provide more normal force pushing down on the stack thereby pushing more trapped air out of the stack of envelopes. The extra force provides by stronger springs provides a more reliable differential between the $F_1$, $F_2$ and $F_3$ forces such that the friction retard principle works better for the wide ranges of media or envelope types tested. The stronger force also prevents the envelope from skewing as it travels into the printer. However, the stronger spring force also aggravates the double feed problem in that it increases the force $F_2$ acting on envelope down in the stack tending to cause the second envelope down in the stack to follow the top envelope when the top enveloped is pulled toward the printer input port. This has caused a need for a more efficient edge separation mechanism which could provide more frictional force tending to retard movement of the second envelope in the stack in following the top envelope. This increased frictional force also meant that the material also needed to be very durable. This search led to the discovery of Buna-N as a material for one of the flexible plates of the edge separation structure. This material is both more durable than urethane, but also applies more frictional force than urethane. Buna-N is used for the second flexible plate 53 of the edge separation structure to be described further below. However, even the Buna-N material did not apply sufficient frictional force to prevent multiple feeds reliably. This problem was overcome by making a change to the software which controls the microprocessor in driving the movable floor 12. This software will be described below.

The feed roller 20 is driven by a chain drive mechanism (not shown) coupling a sprocket on the feed roller with a motor (not shown) under control of the microprocessor (not shown). Any drive mechanism for the feed roller will suffice for purposes of practicing the invention, and the details of the preferred embodiment have been described but not shown in the drawings to avoid unnecessary clutter. The feed roller rotates around a shaft 26 anchored to a frame 28, and the frame 28 pivots about a shaft 36 each end of which is pivotally anchored such as by bearing or bushing in housing 10. Thus, the bias force imposed by the springs 24A and 24B pulling down on shafts 32A and 32B pull the frame 28 down and cause drive roller 20 to impose a normal force downward on the stack 22 of envelopes. A microswitch 40 has an operational arm which is coupled to the shaft 32B to sense movement thereof. The microswitch 40 is coupled to a control microprocessor (not shown in FIG. 1) so as to signal movements of the movable floor 12 up when activated.

Figure 6:
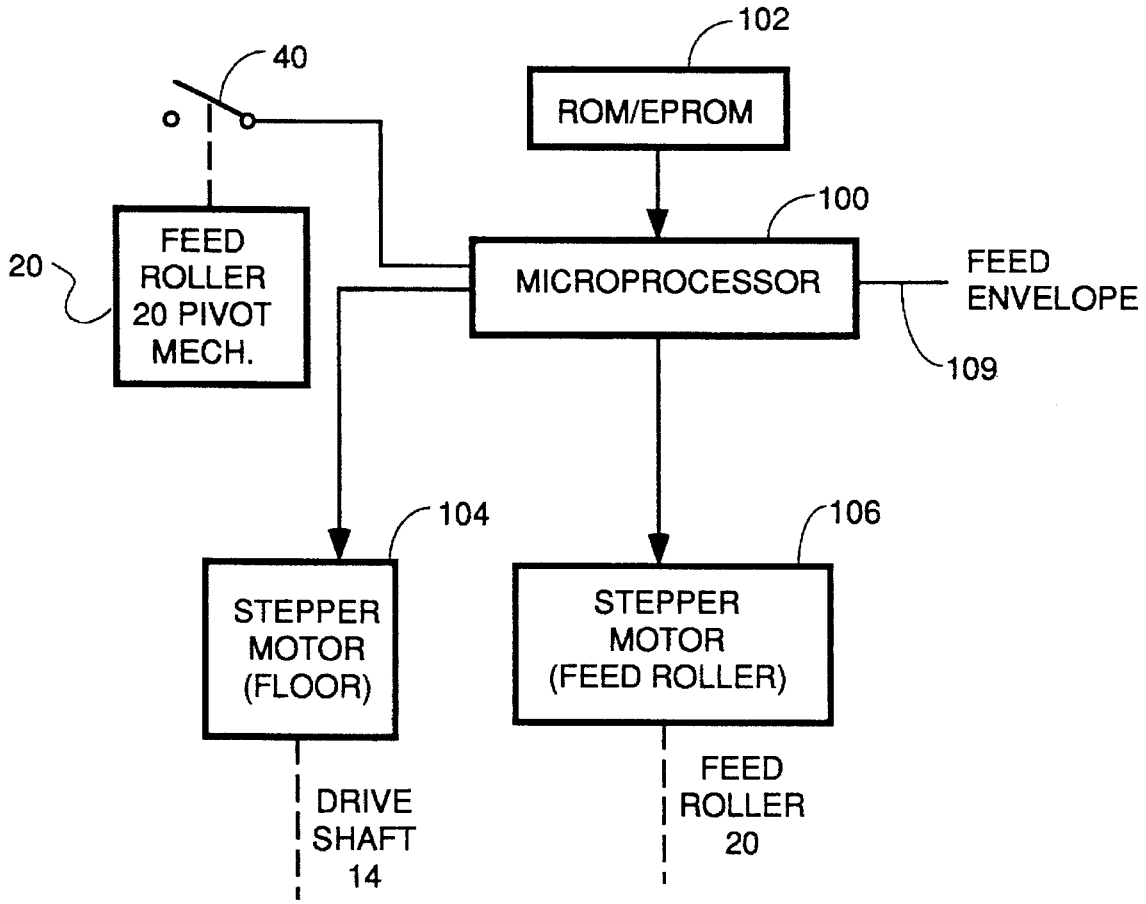
FIG. 6 is a block diagram of the electronics of the envelope feeder.

Referring to FIG. 6, there is shown a block diagram of one embodiment of the electronics which control the envelope feeder. A microprocessor 100 controls all operations under control of a control program stored in ROM or EPROM 102. The microprocessor 100 is coupled to a stepper motor 104 which mechanically drives a drive shaft 14 controlling the movements of belts 16 and its counterpart on the other side so as to be able to control the position of movable floor 12. The microprocessor is also coupled to a microswitch 40 which is mechanically linked to the shafts 32A and 32B which moves up when the feed roller is pushed up by the movements of the floor 12 moving upward sufficiently to compress the stack of envelopes, and which moves down when the movable floor moves down. The microprocessor 100 is also coupled to stepper motor 106 that drives the feed roller 20. The microprocessor 100 is also connected to receive a FEED ENVELOPE signal on line 109 indicating that a new envelope is to be fed into the printer (not shown). The FEED ENVELOPE signal on line 109 comes from either the laser printer or from a microswitch (not shown) in the paper feed path which changes states when an envelope has entered the paper feed path of the printer thereby indicating that the next envelope is to be fed into a position to be engaged by an input feed roller in the printer paper feed path. In the preferred embodiment, the FEED ENVELOPE signal comes from the laser printer. The connections to the various stepper motors and microswitch sensors are only shown symbolically as those skilled in the art will appreciate how to use the address, data and control buses of the microprocessor to control and read the various peripherals shown in FIG. 6.

Figure 3:
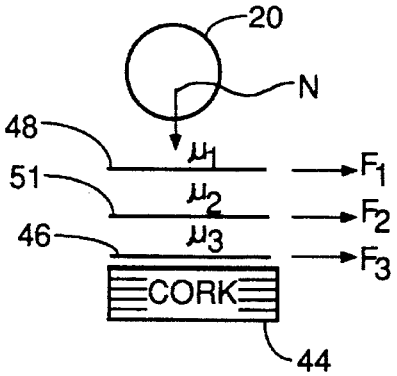
FIG. 3 shows a diagram of the various forces that are involved in the prior art frictional force type of separation.

The control program in memory 102, the microprocessor 100, the microswitch 40, the drive motor 106 for the feed roller 20, and the drive motor 104 for the movable floor 12 cooperate to regulate the normal force N pushing down on the stack of envelopes to compress air out of the individual envelopes in the stack shown in FIG. 3 to keep it as constant as possible as the size of the stack decreases. This is done as follows making reference to FIG. 7 which is a flow chart of the pertinent portion of the control program which controls movements of the movable floor 12. After a stack of envelopes is loaded, the microprocessor commands the motor 104 driving the shaft 14 to rotate the shaft in such a way as to raise the floor 12 of the envelope compartment so as to compress the stack of envelopes against the feed roller 20 and drive out much of the trapped air from the compartments of the envelopes. As the stack of envelopes moves upward, the force pushing upward on the feed roller causes the feed roller 20 to rise thereby causing the shafts 32A and 32B to rise and causing the frame 28 to pivot upward around shaft 36. This upward movement of the shafts 32A and 32B causes the microswitch 40 to change states. This signals the microprocessor to command the motor 104 to stop turning the shaft 14 which in turns stops upward movement of the floor 12 and roller 20. This process is symbolized by block 108 in FIG. 7.

The microprocessor then waits for FEED ENVELOPE signal on line 109 from the printer or a microswitch in the paper feed path of the feeder as in the prior art JT25-XXXX unit requesting feeding of an envelope. Upon receipt of this signal, the microprocessor signals the motor which drives the feed roller 20 to turn the roller 20 in a direction so as to move the top envelope toward the printer. This moves the top envelope past the edge separator mechanism described elsewhere herein and into the paper feed path of the printer. This process is symbolized by steps 110 and 112 of FIG. 7.

To help compensate for increased tendency to double feed caused by the increased normal force applied by springs 24A and 24B, the software which controls movements of the movable floor 12 is modified to manage movements of the floor 12 so as to keep the normal force as equal as possible regardless of the number of envelopes still remaining in the stack. The pertinent portion of the software which implements this function is symbolized by the steps following step 112 in FIG. 7. Basically, the normal force N in FIG. 3 is kept as equal as possible as the stack get smaller by moving the stack upward a small amount after each envelope is fed and checking the status of the microswitch 40. The reason this approach was adopted is because managing the movements of the movable floor 12 simply by checking the status of microswitch 40 proved to lead to "timing jams". The reason for this was that the microswitch tended to stay in the state indicating sufficient normal force was being applied (an open state) for up to about 20 envelopes even though the movable floor 12 had not moved at all. By the time the switch 40 changes states to the closed condition after about the 20th envelope, the time it would take for the stepper motor to move the movable floor up far enough to cause switch 40 to change states again to the open condition would be too long to get the next envelope fed when the printer asks for it. Usually this would result in a jam by virtue of the microprocessor commanding the stepper motor driving the feed roller 20 to feed the next envelope before the normal force N had reached the necessary level for the friction differential principle to work. This could result in a double feed or a jam.

Figure 7:
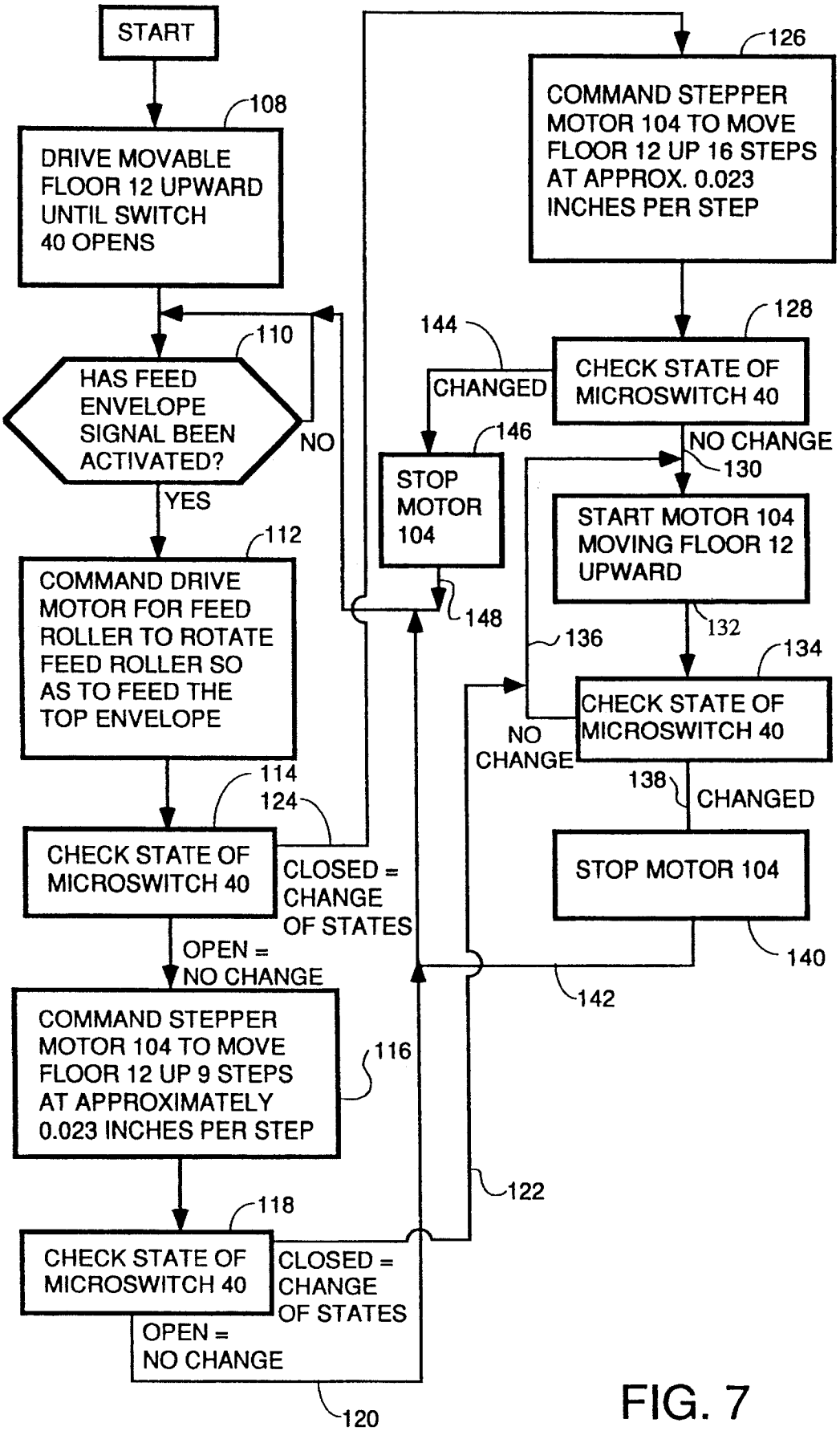
FIG. 7 is a flow chart of the pertinent portion of the software for the envelope feeder microprocessor that manages the normal force to prevent double feeds by controlling the movements of the movable floor 12.

The steps of FIG. 7 eliminate this problem by moving the movable floor 12 up a small amount after each envelope. This process starts with block 114 which represents the process of checking the state of microswitch 40 after the feed roller 20 has fed the top envelope in the stack into the printer. If the switch 40 is still open indicating no change from its previous position achieved by the process of block 108, this indicates that sufficient normal force is still present. In such a case to prevent the problem previously described from occurring, step 116 is performed wherein the microprocessor 100 commands stepper motor 104 to move the floor 12 up by 9 steps. Each vertical step in the preferred embodiment translates into about 0.023 inches of vertical movement, so any embodiment which achieves approximately this amount of upward movement after each envelope will fall within the scope of the invention regardless of the exact mechanical/electrical/software combination used to achieve this movement.

Next, step 118 is performed to read the state of the microswitch 40 to determine if it has changed states. If it is still open, no change of states has occurred, and processing is vectored back to step 110 via path 120. If switch 40 has changed states by closing, processing is vectored via path 122 to a series of steps to be described below which basically moves the floor 12 upward continuously until microswitch 40 changes states.

Returning to the consideration of step 114, if the check of microswitch 40 indicates that it has changed states by closing, path 124 is taken to step 126. This step represents the process carried out by the microprocessor 100 to command the stepper motor 104 to move the floor 12 upward by 16 steps at approximately 0.023 inches per step. Thereafter, step 128 is performed to again check the status of microswitch 40. If there has been no change of states, path 130 is taken to step 132 which represents the process of commanding the stepper motor 104 to begin continuously moving the floor 12 upward. Step 134 is performed next to check the status of microswitch 40, and if no change has yet resulted, processing is vectored along path 136 back to step 132 thereby keeping floor 12 moving upward. Step 134 is therefore performed continuously until a change of states in microswitch 40 is detected, at which time processing is vectored along path 138 to step 140. Step 140 represents the process of commanding the stepper motor 104 to stop turning. Path 142 is then taken back to step 110 to wait the next activation of the FEED ENVELOPE signal.

Returning to the consideration of step 128, if the state of microswitch 40 has changed as detected by step 128, path 144 is taken to step 146 where motor 104 is stopped. Thereafter, path 148 is taken back to step 110 to wait for the next FEED ENVELOPE signal.

A key aspect of the invention is the addition of two plastic envelope separating members to the metal envelope separating plate 42 to provide two additional edges which help separate the envelopes so as to avoid multiple feeds.

Figure 2:
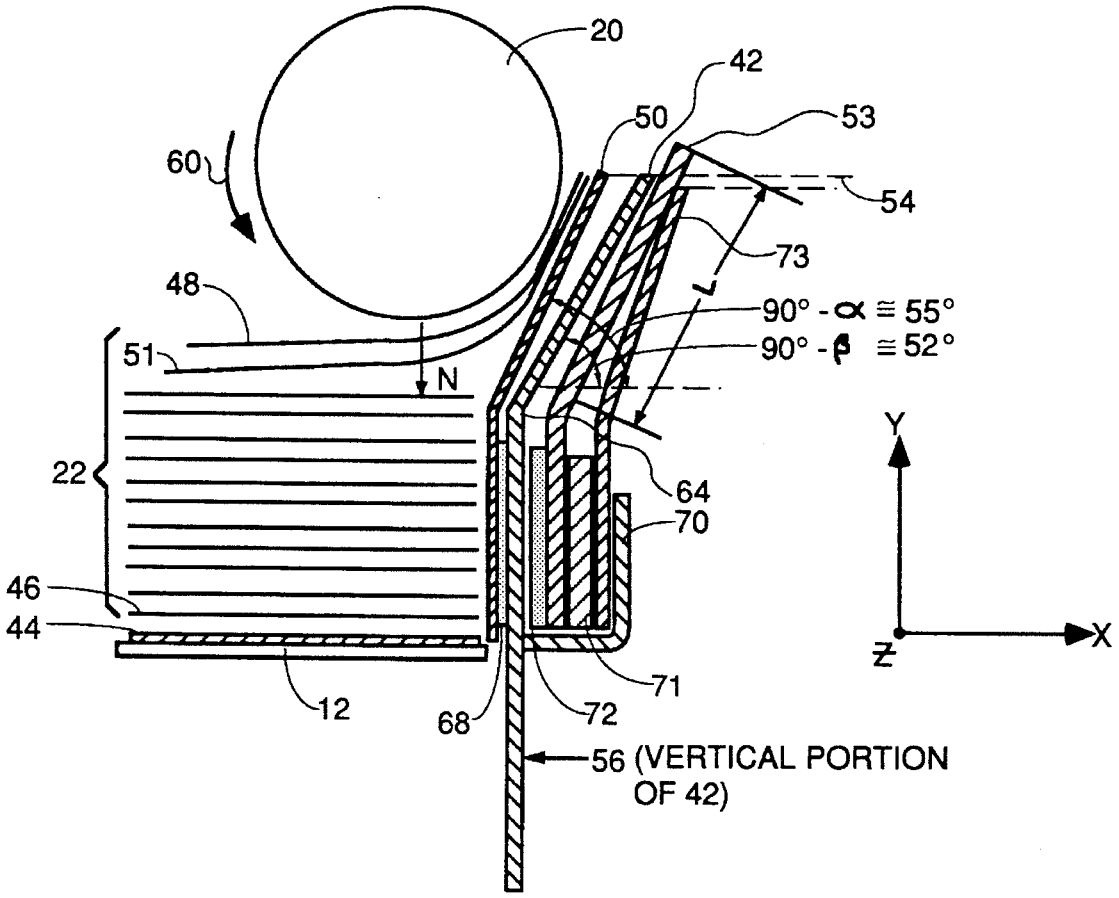
FIG. 2 shows the preferred embodiment of the envelope separating mechanism according to the teachings of the invention in cross section.

Referring to FIG. 2, the details of one aspect of the preferred embodiment of the envelope separating mechanism according to the teachings of the invention is shown in cross section. The feed roller 20 applies the normal force F in the negative Y direction in FIG. 2 under the influence of springs 24A and 24B shown in FIG. 1. This compresses the stack 22 of envelopes against the movable floor 12. A layer of cork 44 lines the bottom of the envelope compartment on the upper surface of movable floor 12 to provide an interface with the bottom envelope 46. In FIG. 2, the envelopes are shown separated from each for clarity, but in reality, the envelopes are in contact with each other and are compressed until excess trapped air is squeezed out.

As illustrated in FIG. 3, the feed roller 20 presses down on the top envelope 48 in the stack and a coefficient of friction of $\mu_1$ defines the frictional forces acting on the top envelope in terms of the following equation (1):

$$\mu_1 = \frac{N}{F_1} \tag{1}$$

where $\mu_1$= the composite coefficient of friction between the drive roller 20 and the top envelope 48 and between the top envelope 48 and the next envelope 51, and N= equals the normal force pushing down on the envelope stack and $F_1$ is the force that it would take to pull the top envelope 48 out of the stack with roller 20 remaining stationary.

The normal force N also defines the frictional force $F_2$ tending to resist pulling of the second envelope 51 out of the stack. The relationship between N and $F_2$ is given by equation (2) below:

$$\mu_2 = \frac{N}{F_2} \tag{2}$$

where $\mu_2$= the composite coefficient of friction between the second envelope 51 and the envelopes above and below it, N is the normal force and $F_2$ is the force to pull the second envelope out of the stack with roller 20 and the envelopes above and below fixed.

The normal force also defines the frictional force $F_3$ it would take to pull the bottom envelope out of the stack. This force is defined by equation (3) below:

$$\mu_3 = \frac{N}{F_3} \tag{3}$$

where $\mu_3$=the composite coefficient of friction between the last envelope in the stack and the bottom cork layer 44 and the last envelope and the envelope just above it, N is the normal force and $F_3$ is the force it would take to pull the bottom envelope out of the stack with roller 20 fixed.

For frictional envelope separation to work, the following relationships must be true:

(4) $F_1 > F_2$ (5) $F_3 > F_2$ (6) $F_1 > F_3$

As noted above, frictional separation does not always work reliably, so to aid this process in separating the envelopes so that only one envelope at a time is fed into the printer, flexible separator elements 50, 53 and 73 have been added on either side of the metal envelope separating plate 42 to implement the teachings of the invention. Flexible plate 50 is preferably LEXAN™ plastic (polycarbonate available commercially from General Electric) of approximately 20 mils thickness. No burrs on the edges of plate 50 are permissible. This first flexible plate 50 is sized such that the top edge terminates on reference plane 54 which is level with the top of the metal envelope separating plate 42. The first flexible plate 50 is affixed to the vertical portion 56 of the metal envelope separating plate 42 by any known means of affixing plastic to metal. Preferably, the means of affixation is such that the flexible plate 50 can be easily removed in case it wears out under heavy usage or is destroyed during maintenance procedures.

The metal envelope separating plate 42 has a vertical portion 56 and an angled portion which has an angle β to the vertical Y axis of from 35°–40°, preferably 38°. It has been found that an angle β of 38° is highly preferred and that having some angle for the angled portion in the range from 35°–40° is critical to good operating performance. The angle β used in the invention is less than the 45° β angle used by the prior art JT25-XXXX envelope feeder.

To provide good envelope separation, the first flexible plate 50 has an angle α to the vertical Y axis which is preferably about 3° less than the angle β (measured relative to the vertical axis) of the metal envelope separating plate 42. Because of the angle α of the first flexible plate 50 is more acute to the vertical than the angle β of the metal envelope separating plate 42, the first flexible plate 50 should be made of a flexible, slippery material to reduce the possibility of blockage of the envelope when it slides to the right and contacts the first flexible plate. Therefore, MYLAR®, LEXAN®, stainless steel or TEFLON® (fluorocarbon resin TFE available commercially from DuPont) are preferred, and the thickness of the first flexible plate 50 should be such that the plate can deflect toward the metal envelope separating plate 42 when the envelope comes into contact with it. LEXAN of 20 mil thickness was chosen for incorporation into the envelope separator according to the teachings of the invention as offering the best tradeoff between flexibility and stiffness.

The first flexible plate 50 is preferably attached to the metal envelope separating plate 42 by mating holes on plate 42 (not shown) with projecting dimples on the vertical portion 56 of the metal envelope separating plate 42 (details of this attachment mechanism not shown). The first flexible plate 50 is spaced away from the metal envelope separating plate 42 by a LEXAN spacer shown at 68 having a thickness of approximately 60–80 mils. The top edge of the spacer 68 should be below the level on the Y axis of the knee 64 in the metal envelope separating plate by about 0.10 inches to provide more flexibility for the first flexible plate 50.

Because of the different angles between plates 50 and 42 and the flexibility of the plate 50, there is room at the tip of the flexible plate 50 to allow the tip of the flexible plate to deflect toward the tip of the metal envelope separating plate 42. The way this assists in separating the envelopes is best understood by examining the interaction between the top two envelopes in the stack with the first flexible plate 50. When the printer requests an envelope to be fed, the feed roller 20 rotates counterclockwise as symbolized by arrow 60. The force generated by this rotation pushes the top envelope 48 to the right until it hits just above the knee 64.

Both the first flexible plate 50 and the metal envelope separating plate 42 have knees which are aligned at the same level on the Y axis and this location must be lower than the level on the Y axis of the top envelope in the stack. The length of the angled portions of the first flexible plate 50 is selected so as to be even with the length of the metal envelope separating plate 42, i.e., so that the tip of the first plate is on the reference plane 54 along with the tip of the metal envelope separating plate 42. It is important that the length of the second flexible plate 53 of Buna-N material (a rubber elastomer having a hardness of 60 plus or minus 5 durometer) extend past the location of the reference plane 54 and, preferably be about 0.15 to 0.20 inches longer than the length of the angled portion of the metal envelope separating plate 42.

Figure 4:
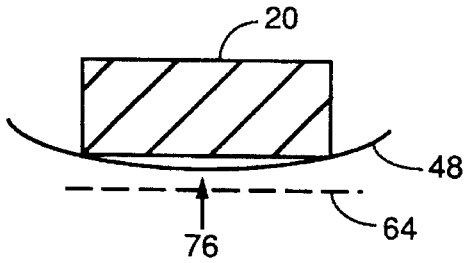
FIG. 4 is a diagram of the required relationship between the bottom of the "smile" in the top envelope caused by the normal force pushing down on the envelope stack and the knee in the separator mechanism.

FIG. 4 illustrates a frontal view looking into the envelope stack and shows how the normal force N pushing down on the envelope stack causes bowing of the top envelope called "smile". It is important that the lowest part of the top envelope smile, shown at 76, be higher on the Y axis than the level on the Y axis of the knee represented by reference number 64. The position of the knee 64 must be established relative to the bottom of the smile in the top envelope and the position of the bottom of the feed roller 20 so as to establish the bottom of the smile above the position of the knee 64. It is also important for effective separation by the first flexible plate that the edge of the top envelope not hit the first flexible plate 50 at a point too high above the knee 64. The rigging of microswitch 40 in FIG. 1 must also be such that the foregoing condition can be met in that it is important to rig the switch to cut off upward travel of the floor 12 before the top envelope in the stack is pushed too high up the Y axis.

When the first envelope hits the knee of the first flexible plate 50, it is deflected upward so as to slide along the surface of the first flexible plate toward the tip pinched by the feed roller 20 and the surface of the flexible plate 50. If the second envelope 51 also starts to slide toward the first flexible plate 50, it too will hit the knee and be deflected upward and start to slide upward between the first envelope and the surface of the first flexible plate 50. Separation of the first envelope 48 from the second envelope 51, if it does not occur before the two envelopes reach the tip 50 will usually occur at the tip of the first flexible plate 50. This is because the tip of the first flexible plate 50 is deflected toward the tip of the metal envelope separating plate 42 as the envelopes slide up along the surface of first flexible plate 50. Because the material of the first flexible plate acts like a spring, a spring bias force originating in the material of the first flexible plate 50 tends to push the tip of the first flexible plate back toward the feed roller. When the edge of the first envelope 48 clears the tip of the first flexible plate 50, the plate 50 springs back ever so slightly and acts as a separation edge to essentially discriminate between the first and second envelopes to block further sliding of the second envelope toward the printer.

The second flexible plate 53 is typically made of straight, flexible plastic such as 1/32 inch thick Buna-N material manufactured by West American Rubber Company. The second flexible plate 53 has no bend therein to form a knee as in the case of first flexible plate 50 and as in the case of the metal edge separating plate 42. The second flexible plate 53 must be longer than the metal edge separating plate so as to engage the bottom surface of the envelope closest to the uppermost edge of the metal edge separating plate 42. This engagement serves to apply a friction force to the bottom of the second envelope 51 if it gets past the separation edges of the first flexible plate 50 and the metal envelope separating plate 42. This tends to retard further movement of the second envelope 51 toward the printer while not impeding further progress of the top envelope 50 toward the laser printer. This improves the chances that the second envelope 51 will not make it all the way to the printer input port thereby causing a multiple feed and jam.

It has been found that 1/32 inch thick Buna-N material is too thin to provide effective edge separation, but such a thickness can be used if a third flexible plate 73 is attached to the back side of the Buna-N second flexible plate 53 by a spacer. This third flexible plate is described further below, but its basic function is to provide some mechanical support for the Buna-N plate 73 while also providing flexibility. Thus, the third flexible plate 73 provide the desired resistance to deflection that the thin Buna-N material cannot provide while the Buna-N material provides the desired coefficient of friction. The surface of the second flexible plate 53 that faces the envelope must be smooth but frictional in the sense that it must cause some frictional force to act on the underside of any second envelope getting that far so as to tend to retard further movement of the second envelope toward the printer.

Both the second flexible plate 53 and the third flexible plate 73 are made of straight material with no bends therein. Both flexible plates are physically coupled to the vertical portion 56 of the metal edge separating plate in such a manner that were it not for the bent upper portion of the metal edge separating plate, both the second flexible plate 53 and the third flexible plate 73 would stick straight up parallel to the Y axis. The second bent over portion of the metal edge separating plate 42 deflects the second and third flexible plates 53 and 73, respectively, so as to put both under bending stress. This causes both to have a spring-like tendancy to want to push up against the underside of any second envelope 51 getting past the uppermost edge of the metal edge separating plate 42. This aids in increasing the frictional forces applied by the second flexible plate 53 on the underside of any second envelope 51 tending to retard movement of the second envelope toward the printer.

The second flexible plate 53 of Buna-N material is attached to the separator mechanism by pushing it down into a space between a finger 70 punched out of the metal of the metal envelope separating plate 42 and the main vertical portion 56 of the metal envelope separating plate 42. In the preferred embodiment, two fingers 70 are used. A MYLAR sheet 72 (not drawn to scale) which is 3 mils thick is interposed between the plastic of the vertical portion of the second flexible plate 53 and the vertical portion 56 of the metal envelope separating plate 42. The purpose of the 3 mil mylar spacer 72 is to facilitate installation of the Buna-N second flexible plate into the space between the finger(s) 70 and the vertical portion 56 of the metal envelope separating plate 42.

A 20 mil thick LEXAN plastic spacer 71 is interposed between the second flexible plate 53 and the inside edge of the finger(s) 70. The purpose of this piece 71 is to provide more space between the second flexible plate 53 and a 10 mil thick LEXAN support 73. This provides more space for the LEXAN support 73 to move back and forth thereby providing a tactile spring action tending to push the second flexible plate 53 toward the underside of any second envelope that makes it past the separation edges of the LEXAN first flexible plate 50 and the metal edge separator 42. This additional force and the spring action of the flexible support 73 that provides it are important in providing good edge separation sufficient to accomodate a wide variety of media types. The length of the flexible support 73 is such that its tip lies just below the plane 54 in which the tip of the metal envelope separation plate 42 lies by an amount equal approximately to the thickness of the metal of separation plate 42.

The flexible support 73, spacer 71 and second flexible plate 53 for an edge separator pad that would be straight were it not for the bending influence of the metal edge separation plate 42.

Preferably, the length L of the second flexible plate 53 is approximately 0.15 to 0.20 inches longer than the corresponding length of the metal envelope separating plate 42 so as to put the tip of the second flexible plate 53 on the reference plane 54 along with the tip of the metal envelope separating plate 42. This provides a "last chance" edge for separating envelopes if the edges of the plates 50 and 42 do not make the separation.

In alternative embodiments, edge separation of a more effective nature can be achieved by using only the first flexible plate 50 alone or only the second flexible plate 53 alone.

Figure 5:
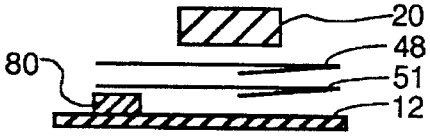
FIG. 5 illustrates a bump in the bottom of the movable floor of the envelope compartment which evens the height of the stack of the envelopes for compensating for the greater thickness of an envelope at the flap edge than at the non-flap edge.

FIG. 5 illustrates a bump or raised portion 80 positioned on the surface of the movable floor 12 which faces the envelope stack and positioned on the side of the centerline of the floor opposite the side on which the flap edges of the envelopes reside. The purpose of the bump or raised podion is to compensate for the double thickness of the envelopes at the edges thereof where the flaps fold over. When 250 such envelopes are stacked with their flap edges on the same side, the height of the top surface of the stack will be greater on the edge where the flaps reside than on the edge without the flaps. The bump compensates for the thinner cross section of a typical envelope on the non-flap edge such that the top of the stack of envelopes will be even in height. This prevents skewed feeding into the printer which can skew the printing on the envelope.

Although the invention has been described in terms of the preferred and alternative embodiments disclosed herein, those skilled in the art will appreciate various substitutions which may be made for various elements in the disclosed embodiments which do not alter the basic functionality of each element and the functional interaction between the elements. In addition, certain other modifications may also be appreciated which do not alter the basic principle of operation and the interplay and functional interdependency of the combined elements. All such modifications and substitutions are within the scope of equivalents under the doctrine of equivalents and 35 U.S.C. Section 112, Paragraph 6 claim interpretation of means plus function claims appended hereto.

What is claimed is:

1. An envelope feeder for feeding one envelope at a time from a stack of envelopes to a printer, comprising:

a housing for protecting a stack of envelopes each of which has a flap which folds over, said stack of envelopes having an axis passing through each envelope;

a movable floor within said housing having a raised portion thereof on one side of said floor so as to compensate for the greater thickness of the envelopes at the edges having the flaps so as to cause a large stack of envelopes resting on said floor to have a top surface which is approximately level;

a motor and belt drive system controlled by a microprocessor to raise said floor;

a feed roller means located within said housing adjacent the top of said stack of envelopes and coupled to a motor controlled by said microprocessor, for friction engaging an envelope from the top of said stack and rotating so as to move said envelope out of said stack, said feed roller means including a feed roller mounted on a pivoting frame which is coupled to said housing so as to pivot about a pivot point, and further comprising at least one spring coupled between said frame and said housing so as to cause said feed roller to press down on the top envelope of said stack of envelopes in said housing with a normal force $F_1$, and wherein the force required to pull an envelope out of the middle of said stack of envelopes is $F_2$ and wherein the force required to pull an envelope out from the bottom of said stack is $F_3$;

separation means for engaging said top envelope and any other envelope(s) further down in said stack which may also be moving out of said stack under the influence of frictional forces generated by said feed roller means and for applying forces to said envelopes so as to block all but said top envelope from reaching said printer; and and further comprising program means for controlling said microprocessor to control said motor which drives said feed roller such that when a signal is received indicating an envelope is to be taken off the top of the stack, for rotating said feed roller in such a manner as to drive at least the top envelope in the stack toward said separation means, and for controlling said microprocessor to control said motor which drives said belt drive system so as to cause said floor to be raised incrementally after each envelope is moved to said separation means so as to keep said spring in a state of stretch such that the following inequalities are true substantially all the time when an envelope is being fed from the top of the stack of envelopes: force: $F_1$ is greater than force $F_2$, and force $F_3$ is greater than force $F_2$, and force $F_1$ is greater than force $F_3$.

2. The apparatus of claim 1 wherein at least part of said movable floor is lined with cork and wherein said feed roller means includes a roller comprised of EPDM rubber of durometer value 45±5, Shore A.

3. An envelope feeder for feeding one envelope at a time from a stack of envelopes to a printer, comprising:

a housing for protecting a stack of envelopes each of which has a flap which folds over, said stack of envelopes having an axis passing through each envelope:

a movable floor within said housing having a raised portion thereof on one side of said floor so as to compensate for the greater thickness of the envelopes at the edges having the flaps so as to cause a large stack of envelopes resting on said floor to have a top surface which is approximately level;

a motor and belt drive system controlled by a microprocessor to raise said floor;

a feed roller means located within said housing adjacent the top of said stack of envelopes and coupled to a motor controlled by said microprocessor, for friction engaging an envelope from the top of said stack and rotating so as to move said envelope out of said stack;

separation means for engaging said top envelope and any other envelope(s) further down in said stack which may also be moving out of said stack under the influence of frictional forces generated by said feed roller means and for applying forces to said envelopes so as to block all but said top envelope from reaching said printer; and wherein said separation means includes a metal edge separating plate adjacent said stack of envelopes and having a first portion which is aligned so as to be parallel to said axis of said stack and having a second portion which joins said first portion at a knee and which has a substantially flat surface inclined relative to said axis at an acute angle of approximately from 35°–40° relative to said axis, and having a first flexible plate affixed to said metal edge separating plate but spaced apart therefrom by a first spacer, said first flexible plate having a first portion which is aligned so as to be parallel to said axis of said stack and having a second portion which joins said first portion at a knee which is substantially aligned with said knee of said metal edge separating plate, said second portion having a substantially flat surface inclined relative to said axis at an acute angle which is approximately 3° less than the angle of said second portion of said metal edge separating plate relative to said axis of said stack, and wherein said separation means is positioned in said housing such that when said top envelope moves out of said stack under the influence of said driver roller means, an edge of said top envelope engages said first flexible plate at a point above said knee and bends upward so as to slide along said surface of said second portion of said first flexible plate while simultaneously deflecting said first flexible plate toward said metal edge separating plate.

4. The apparatus of claim 3 wherein said first flexible plate is comprised of flexible plastic with a smooth surface along which said top envelope slides, and wherein said second portion of said first flexible plate is long enough to touch a reference plane orthogonal to said axis of said stack and in which lies at least one point on the tip of said second portion of said metal edge separating plate furthest from the knee thereof.

5. The apparatus of claim 4 wherein said first flexible plate is comprised of LEXAN plastic having a thickness of approximately 20 mils, and wherein said spacer has a thickness of from 60–80 mils.

6. The apparatus of claim 4 wherein said second portion of said metal separating plate is inclined relative to said axis of said stack at an angle of approximately 38°.

7. The apparatus of claim 1 wherein said separation means includes a metal edge separating plate adjacent said stack of envelopes and having a first portion which is aligned so as to be parallel to said axis of said stack and having a second portion which joins said first portion at a knee and which has a substantially flat surface inclined relative to said axis at an acute angle of approximately from 35°–40° relative to said axis, and having a flexible plate affixed to the side of said metal edge separating plate furthest from said stack of envelopes, but spaced apart therefrom, said flexible plate having a first portion which is aligned so as to be parallel to said axis of said stack and having a second portion which joins said first portion at a knee which is substantially aligned with said knee of said metal edge separating plate, said second portion having a substantially flat surface inclined relative to said axis at an acute angle which is approximately the same as the angle of said second portion of said metal edge separating plate relative to said axis of said stack, and wherein said separation means is positioned in said housing such that when said top envelope moves out of said stack under the influence of said driver roller means, an edge of said top envelope engages said metal edge separating plate at a point above said knee and bends upward so as to slide along said surface of said second portion of said metal edge separating plate.

8. The apparatus of claim 1 wherein said separation means includes a metal edge separating plate adjacent said stack of envelopes and having a first portion which is aligned so as to be parallel to said axis of said stack and having a second portion which joins said first portion at a knee and which has a substantially flat surface inclined relative to said axis at an acute angle of approximately from 35°–40° relative to said axis, and having a first flexible plate affixed to said metal edge separating plate but spaced apart therefrom by a first spacer, said first flexible plate having a first portion which is aligned so as to be parallel to said axis of said stack and having a second portion which joins said first portion at a knee which is substantially aligned with said knee of said metal edge separating plate, said second portion having a substantially flat, smooth surface inclined relative to said axis at an acute angle which is approximately 3° less than the angle of said second portion of said metal edge separating plate relative to said axis of said stack, said separation means further comprising a second flexible plate affixed to the side of said metal edge separating plate furthest from said stack of envelopes, but spaced apart therefrom, said second flexible plate having a first portion which is aligned so as to be parallel to said axis of said stack and having a second portion which joins said first portion at a knee which is substantially aligned with said knee of said metal edge separating plate, said second portion having a substantially flat surface inclined relative to said axis at an acute angle which is approximately the same as the angle of said second portion of said metal edge separating plate relative to said axis of said stack, and wherein said separation means is positioned in said housing such that when said top envelope moves out of said stack under the influence of said driver roller means, an edge of said top envelope engages said first flexible plate at a point above said knee and bends upward so as to slide along said surface of said second portion of said first flexible plate while simultaneously deflecting said first flexible plate toward said metal edge separating plate, and wherein said second portion of said second flexible plate has a length which is longer than the length of said second portion of said metal edge separating plate.

9. The apparatus of claim 8 wherein the length of said second portion of said second flexible plate is sufficient such that the tip of said second flexible plate furthest from the knee thereof extends past the tip of said metal edge separating plate furthest from the knee thereof by a distance of approximately 0.15 to 0.20 inches.

10. The apparatus of claim 9 wherein said second flexible plate is separated from said metal edge separating means by a cork spacer.

11. The apparatus of claim 9 wherein said second flexible plate is comprised of 1/16 inch thick urethane of 60–70 durometer hardness.

12. The apparatus of claim 9 wherein said second flexible plate is comprised of 1/32 inch thick urethane and has a polyester fiber pad backing.

13. The apparatus of claim 9 wherein said spacer between said first flexible plate and said metal edge separating plate ends approximately 0.1 inches below said knee, below means in a direction relative to the top of said stack so as to be further from the top of said stack in a direction going toward said movable floor than is said knee of said first flexible plate.

14. An envelope feeder for feeding one envelope at a time from a stack of envelopes to a printer, comprising:

a housing for protecting a stack of envelopes each of which has a flap which folds over, said stack of envelopes having an axis passing through each envelope and orthogonal to the set of parallel planes in which the envelopes lie;

a movable floor within said housing having a raised portion thereof on one side of said floor so as to compensate for the greater thickness of the envelopes at the edges having the flaps so as to cause a large stack of envelopes resting on said floor to have a top surface which is approximately level;

a motor and belt drive system controlled by a microprocessor to selectively raise said floor;

a feed roller located within said housing adjacent the top of said stack of envelopes and coupled to a motor controlled by said microprocessor, said feed roller for friction engaging an envelope from the top of said stack and rotating so as to move said envelope out of said stack;

an envelope separation structure comprising a metal edge separating plate adjacent said stack of envelopes and having a first portion which is aligned so as to be parallel to said axis of said stack and having a second portion which joins said first portion at a knee and which has a substantially flat surface inclined relative to said axis at an acute angle of approximately from 35°–40° relative to said axis, and having a first flexible plate affixed to said metal edge separating plate but spaced apart therefrom by a first spacer, said first flexible plate having a first portion which is aligned so as to be parallel to said axis of said stack and having a second portion which joins said first portion at a knee which is substantially aligned with said knee of said metal edge separating plate, said second portion having a substantially flat, smooth surface inclined relative to said axis at an acute angle which is approximately 3° less than the angle of said second portion of said metal edge separating plate relative to said axis of said stack, said separation means further comprising a second flexible plate affixed to the side of said metal edge separating plate furthest from said stack of envelopes, but spaced apart therefrom, said second flexible plate having a first portion which is aligned so as to be parallel to said axis of said stack and having a second portion which joins said first portion at a knee which is substantially aligned with said knee of said metal edge separating plate, said second portion having a substantially flat surface inclined relative to said axis at an acute angle which is approximately the same as the angle of said second portion of said metal edge separating plate relative to said axis of said stack, and wherein said separation means is positioned in said housing such that when said top envelope moves out of said stack under the influence of said driver roller means, an edge of said top envelope engages said first flexible plate at a point above said knee and bends upward so as to slide along said surface of said second portion of said first flexible plate while simultaneously deflecting said first flexible plate toward said metal edge separating plate, and wherein said second portion of said second flexible plate has a length which is longer than the length of said second portion of said metal edge separating plate.

15. The apparatus of claim 14 wherein the length of said second portion of said second flexible plate is sufficient such that the tip of said second flexible plate furthest from the knee thereof extends past the tip of said metal edge separating plate furthest from the knee thereof by a distance of approximately 0.15 to 0.20 inches.

16. The apparatus of claim 15 wherein said second flexible plate is separated from said metal edge separating means by a cork spacer.

17. The apparatus of claim 16 wherein said second flexible plate is comprised of 1/16 inch thick urethane of 60–70 durometer hardness.

18. The apparatus of claim 16 wherein said second flexible plate is comprised of 1/32 inch thick urethane and has a polyester fiber pad backing.

19. The apparatus of claim 16 wherein said spacer between said first flexible plate and said metal edge separating plate ends approximately 0.1 inches below said knee, below means in a direction relative to the top of said stack so as to be further from the top of said stack in a direction going toward said movable floor than is said knee of said first flexible plate.

* * * * *